US006808695B1

(12) United States Patent
Chaplin

(10) Patent No.: US 6,808,695 B1
(45) Date of Patent: Oct. 26, 2004

(54) PROCESS FOR CONTINUOUSLY PRODUCING ALUMINUM FROM CLAYS

(75) Inventor: Gervase M. Chaplin, Gretna, LA (US)

(73) Assignee: Toth Aluminum Corporation, Vacherie, LA (US)

( * ) Notice: Subject to any disclaimer, the term of this patent is extended or adjusted under 35 U.S.C. 154(b) by 0 days.

(21) Appl. No.: 09/576,368

(22) Filed: May 22, 2000

(51) Int. Cl.[7] ..... C01F 7/62

(52) U.S. Cl. ..... 423/495; 423/493; 423/496; 423/135

(58) Field of Search ..... 423/495, 496, 423/493, 135

(56) References Cited

U.S. PATENT DOCUMENTS

| | | | | | |
|---|---|---|---|---|---|
| 2,843,455 | A | * | 7/1958 | Pardee | 423/495 |
| 3,341,283 | A | * | 9/1967 | Cleaver et al. | 423/495 |
| 4,035,169 | A | * | 7/1977 | Sebenik et al. | 423/495 |
| 4,039,647 | A | * | 8/1977 | Wohleber et al. | 423/495 |
| 4,252,774 | A | * | 2/1981 | Loutfy et al. | 423/495 |
| 4,514,373 | A | * | 4/1985 | Wyndham | 423/495 |
| 4,695,436 | A | * | 9/1987 | Wyndham et al. | 423/496 |
| 4,891,204 | A | * | 1/1990 | Robinson | 423/495 |

FOREIGN PATENT DOCUMENTS

| | | | | |
|---|---|---|---|---|
| CA | 515992 | * | 8/1955 | 423/495 |
| GB | 2145401 | * | 3/1985 | 423/495 |
| SU | 199128 | * | 9/1967 | 423/495 |

* cited by examiner

*Primary Examiner*—Ngoc-Yen Nguyen
(74) *Attorney, Agent, or Firm*—Michael D. Carbo

(57) ABSTRACT

A process for purifying solid crude aluminum chloride, containing iron impurities, includes the steps of mixing iron with the crude aluminum chloride and reactively subliming and desubliming the mixture. A process for continuous production of metal chlorides includes the steps of providing metallic ore, containing iron purities, and a carbon source; drying the metallic ore; drying the carbon source; mixing the dried metallic ore, the dried carbon source, and a sulfur-containing compound; calcining the mixture in a first fluidized bed reactor in the presence of air; chlorinating the calcined product in a second fluidized bed reactor in the presence of additional carbon source and additional sulfur-containing compound to produce crude metal chlorides and waste gases; and reactively subliming and desubliming the crude metal chlorides, in the presence of additional iron, aluminum, cesium, copper, lead, lithium, magnesium, mercury, potassium, sodium, titanium, uranium, zinc or zirconium, to produce purified aluminum chloride.

33 Claims, 1 Drawing Sheet

PROCESS FOR CONTINUOUSLY PRODUCING ALUMINUM FROM CLAYS

CROSS-REFERENCE TO RELATED APPLICATIONS

NONE

STATEMENT REGARDING FEDERALLY SPONSORED OR DEVELOPMENT

NONE

BACKGROUND OF THE INVENTION

1. Field of the Invention

The present invention relates to pyrometallurgical processing, including a process for producing aluminum metal and titanium tetrachloride from clays containing hydrous aluminum silicate and titanium. More particularly, the present invention relates to a process for improving yield in removing iron in the purification of aluminum chloride through the addition of iron particles or equivalent iron containing compounds. The reactive sublimation of impure aluminum chloride with a reducing agent of iron in finely divided form substantially purifies the impure aluminum chloride. The purified aluminum chloride can then be effectively smelted into aluminum by aluminum chloride smelting processes.

2. Description of Related Art

For over one hundred years, a customary method of producing aluminum commercially has been the well-known Hall-Heroult process in which alumina dissolved in a fluoride bath (principally cryolite) is reduced electrolytically. The Hall-Heroult process requires a feed of pure alumina, which is typically produced commercially by the Bayer process, which in turn requires a feedstock of high grade bauxite. Bauxite occurs in few areas of the world, and no commercial deposits exist in North America.

Production of aluminum by electrolysis of aluminum chloride dissolved in a molten electrolyte composed of one or more halides having higher electrodecomposition potential than aluminum chloride (e.g., alkali metal halide or alkali earth metal halide) has been described in the literature; for example, Z. fur Elektrochemie, Vol. 54, pp. 210–215, U.S. Pat. Nos. 1,296,575, 1,854,684, 2,919,234, 3,103,472, 3,725,222 and Canadian Patent No. 502,977. This aluminum chloride smelting was initially thought to promise higher energy efficiency than the Bayer-Hall-Heroult process, but the promise went unrealized commercially because of problems and costs related to impurities in the aluminum chloride.

Purity of aluminum chloride feedstock is deemed essential to successful commercial production of aluminum by electrolysis of the aluminum chloride in a molten electrolyte. U.S. Pat. No. 3,725,222, assigned to Alcoa, disclosed that it is highly important that the concentration of metal oxides in the bath, expressed as oxygen, be kept below 0.25 percent by weight, and preferably below 0.1 percent by weight, and more preferably, below 0.05 percent. Alcoa's smelting process utilized Bayer alumina that was chlorinated by first spraying fuel oil onto hot alumina particles, which pyrolized the oil into reactive carbon deposited on the alumina particle surfaces, and then reacting the carbonized aluminum with chlorine. Alcoa did not use aluminum chloride from low grade clays.

Production of purified aluminum chloride from low grade aluminous materials, including kaolin clays, bauxites, aluminum phosphate, shale and other raw materials by a carbo-chlorination process, followed by oxidation of the purified aluminum chloride into high grade aluminum oxide is disclosed in U.S. Pat. Nos. 3,935,297, 3,937,786, 3,938,969, 3,950,485, 3,956,454, 4,035,169, 4,082,833, 4,083,923, 4,083,927, 4,203,962, 4,220,629, 4,514,373, 4,695,436, and 4,710,369. This process of carbo-chlorination was directed to replacing bauxite-based aluminum oxide with aluminum oxide produced by the oxidation of purified aluminum chloride. For example, U.S. Pat. Nos. 4,514,373 and 4,695,436 disclose a process for producing substantially pure aluminum chloride by subliming and desubliming solid crude metal chlorides, which have been combined with aluminum powder. The other metal chlorides are separated from the aluminum chloride. But this process is less cost effective because of the cost of aluminum powder. Also, any excess aluminum powder is not easily or cost effectively recoverable.

Accordingly, it is an object of the present invention to provide a more cost effective process for purifying aluminum chloride. It is further object of the invention to improve the production of purified aluminum chloride for use in the production of aluminum by electrolysis of aluminum chloride.

It is another object of the invention to provide a continuous process for producing aluminum from low grade aluminous materials.

It is yet another object of this invention to provide a process for obtaining titanium tetrachloride and silicon tetrachloride from low grade aluminous materials containing titania and silica.

These and other objects will be apparent from the description of the invention and the claims, taken in conjunction with the drawing, or by practice of the invention.

SUMMARY OF THE PRESENT INVENTION

What is provided is a process in which aluminous ore, a carbon source, and other raw materials are used to make and purify aluminum chloride, titanium tetrachloride, and silicon tetrachloride. Ores usable in this invention are those containing aluminum oxides and silicates that may be carbo-chlorinated using the instant catalyst at a temperature range of approximately 500° C. to approximately 1000° C. Examples of such ores include kaolinitic, illitic, and other aluminum clays; bauxite clay and other bauxite ores; siliceous bauxites and sillimanites; kyanites; aluminus shale, slates and fuel ashes; nepheline syenties; and anorthosite. The carbon source which is used in the drying process may be a carbonaceous gas such as carbon monoxide or carbonyl chloride or phosgene, or it may be one of a number of coal cokes or chars, including cokes and chars from lignite, petroleum coke and peat. The process is generally comprised of the following steps:

Step 1—Drying

The aluminus ore is fed into a dryer where it is dried with off gases from a calciner at a temperature range between approximately 100° C. and 200° C. The dryer removes the free water from the aluminous ore. The carbon source is fed to a dryer where it is dried under controlled atmosphere, low in oxygen, between approximately 100° C. and 150° C.

Step 2—Calcination

The pyrometallurgical calcination step utilizes elevated temperatures to remove the chemically bound water from the aluminus ore at a temperature of between 600° C. and 950° C. The ore must be dried and removed of free water and chemically bound water to prevent objectionable hydrolysis of metal chlorides or the formation of corrosive hydrochloric acid.

Step 3—Chlorination

During the chlorination step, a chlorinating agent such as dry chlorine gas and/or a functionally equivalent chlorine compound is combined with the ore, catalyst, and reductant, at elevated temperature of 600° C. to 1000° C.

Step 4—Condensation

The solids condensation system receives the hot vapors from the chlorinator and recovers heat and condenses crude, impure aluminum chloride. A heat exchanger and aluminum chloride condenser are used to the solids condensation system.

Step 5—Liquids Condensation

The uncondensed vapors from the solids condensation unit flow into the liquids condensation system for condensation of approximately 98% of the silicon tetrachloride and 98% of the titanium tetrachloride.

Step 6—Silicon Tetrachloride and Titanium Tetrachloride Purification

The liquid mixture recovered in Step 5 is directed to conventional rectification and condensation equipment for separation of the silicon tetrachloride and titanium tetrachloride and further purification of silicon tetrachloride and titanium tetrachloride.

Step 7—Aluminum Chloride Purification (Blender)

During the blending operation, the crude solid aluminum chloride compound and powdered metal, preferably iron at the feed rate of 1–5 molar relative to the metal impurity level in the crude aluminum chloride, are fed into a blender.

Step 8—Multi-State Sublimation

A first sublimer commonly used in sublimation processes receives the mixture from the blender and, operating at a temperature of at least 180° C. and a pressure of at least one atmosphere, the solid aluminum chloride sublimes to aluminum chloride vapor at these conditions. These steps of sublimation and desublimation are repeated until high purity aluminum chloride is achieved.

Step 9—Granulated Metal Reactor

The pure aluminum chloride from the sublimer may be directed through a granulated metal reactor where is comprised of solid granules or activated granular metal which removes the sulfur impurities and non-aluminum metal chloride traces.

Step 10—Aluminum Chloride Condenser

The purified aluminum chloride vapor/nitrogen mixture is then directed into the condenser where the aluminum chloride solidifies at a temperature between 40° C. and 180° C.

Step 11—Aluminum Chloride Smelting

The purified solid aluminum chloride is then directed to closed smelting cells where the aluminum chloride is dissolved in a molten electrolyte comprised of one or more halides having higher electrodecomposition potential than aluminium chloride and is converted by electrolysis into aluminum metal and chlorine.

Step 12—Chlorine Recovery

Chlorine from the electrolysis cells is cooled, compressed, liquefied and stored for recycle to the second fluidized bed reactor.

Step 13—Pollution Control

The pollution control system scrubs the waste gases from the system with an alkali solution before they are released to the atmosphere, where they then contain mostly carbon dioxide.

DETAILED DESCRIPTION OF THE INVENTION

Figure 1:
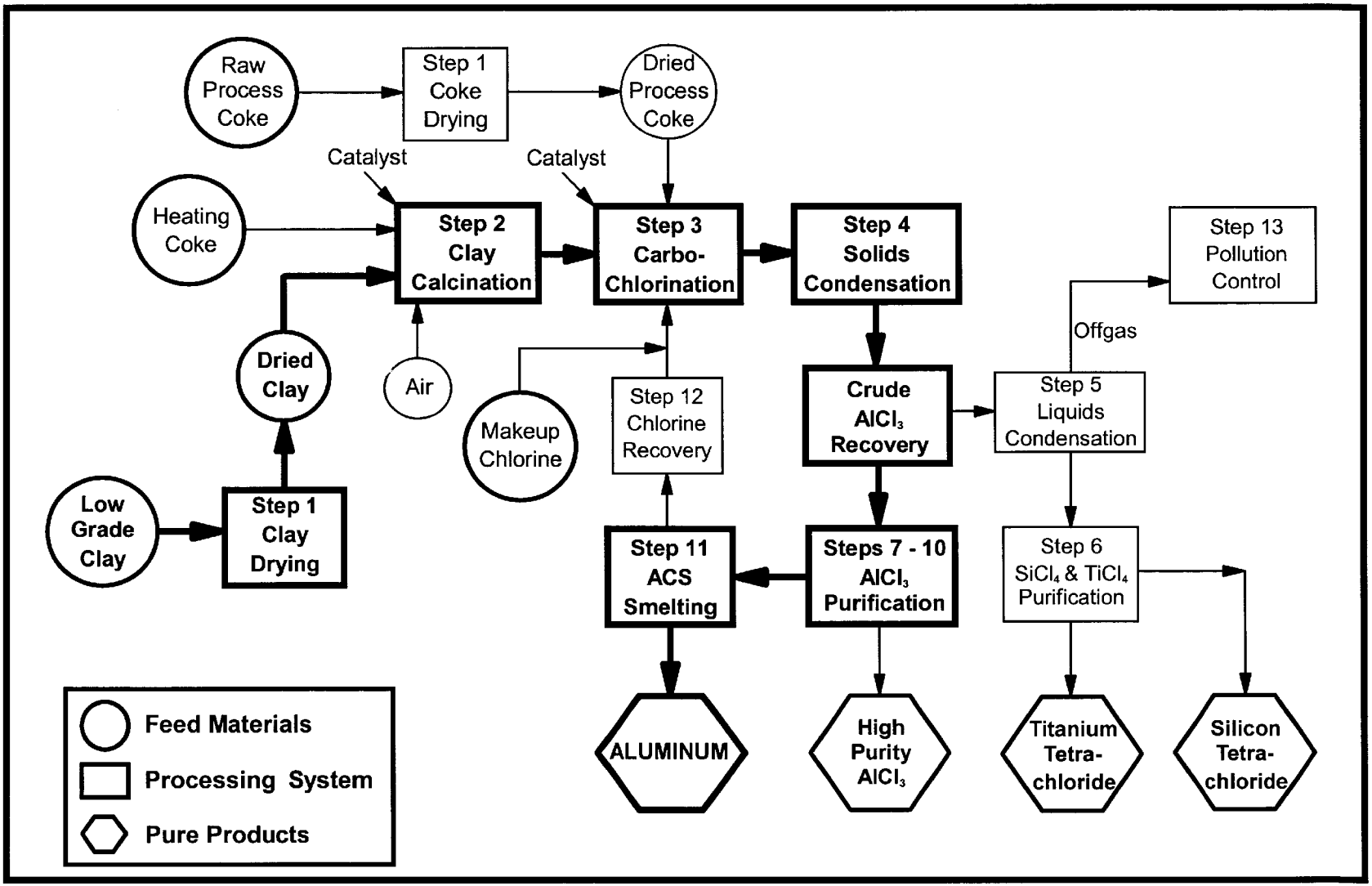
FIG. 1 is a block diagram illustrating the production of aluminum metal and titanium tetrachloride from clay, according to the invention.

In the production of substantially pure aluminum chloride in accordance with this invention, aluminum chloride containing iron impurities is combined with additional iron in finely divided form, and the resulting mixture is reactively sublimed and desublimed in a sequence of heated reactors. Preferably, the additional iron is added at a rate of 1–5 molar relative to the metal impurity level in the crude aluminum chloride. When impure aluminum chloride containing up to approximately 20% by weight of ferric chloride is reactively sublimed, the finely divided iron acts as a reducing agent to reduce the valence state of iron from valence state III (ferric) to valence state II (ferrous). The resulting ferrous chloride has a substantially lower vapor pressure at the temperature of sublimation of aluminum chloride. The lower vapor pressure retards the evaporation of iron into the vaporous aluminum chloride, thereby achieving a sequential, stagewise decrease of iron in aluminum chloride. The additional iron is added at each stage. After each reaction stage, the impurity level of iron in the aluminum chloride decreases. The number of such stages can be selected to achieve a final desired purity level. For example, after three such stages, in which the sublimed aluminum chloride vapor is reacted in three sequential reactors containing iron particles, and held at a temperature of between 300° C. and 500° C., the iron content of the resultant aluminum chloride is reduced to about 20 parts per million.

The purification process also includes condensing liquid titanium tetrachloride and silicon tetrachloride from the metal chlorides. The titanium tetrachloride can be recovered, purified and sold, and chlorine can be recovered from the silicon tetrachloride and recycled to the chlorination process.

In the improved process according to the invention, aluminous ore dried to about 5% moisture and a carbon source dried to about 1% moisture are mixed with a sulfur-containing compound, the mixture is calcined in a first fluidized bed reactor in the presence of air at a temperature between about 600° C. and about 900° C., the calcined product is chlorinated in a second fluidized bed reactor at a temperature between about 700° C. and about 1000° C. in the presence of additional carbon source and additional sulfur-containing compound to produce crude metal chlorides and waste gasses, and the crude metal chlorides are reactively sublimed and desublimed in the presence of finely divided iron within a temperature range of between about 180° C. and about 350° C. and at a pressure of one atmosphere, the subliming and desubliming being repeated in multiple stages to achieve a desired purity of aluminum chloride. Excess iron particles additionally can be recovered by a magnetic separation process.

The aluminum chloride vapor is passed through a series of reactors, packed with iron particles, at a temperature of between about 200° C. and about 500° C. Using finely divided iron as a reducing agent to separate iron chloride from the aluminum chloride is useful for purifying low grade aluminous materials, for providing substantially pure aluminum chloride for aluminum smelting, and for providing a continuous process for producing aluminum from low grade aluminous clays.

The invention is not limited to the particular example disclosed herein.

More generally, virtually all metals, not only aluminum, can be chlorinated to yield their metal chlorides. The group that appears most susceptible to chloride based separation recovery and purification according to the invention include the following: aluminum, antimony, arsenic, beryllium, bismuth, boron, cadmium, cerium, chromium, cobalt, copper, gallium, germanium, gold, hafnium, holmium, indium, iridium, iron, lead, lithium, magnesium, manganese, mercury, molybdenum, nickel, niobium, osmium, palladium, phosphorus, platinum, ruthenium, samarium, scandium, selenium, silicon, tantalum, tellurium, terbium, thallium, thulium, tin, titanium, tungsten, uranium, vanadium, zinc and zirconium. The metal chlorides of this group of metals are referred as Chaplin metal chlorides. The group is referred to as the Chaplin metal chloride group.

Moreover, metals other than iron that act similar to iron in the reduction of ferric chloride to ferrous chloride can be used in the reactive sublimation step. Such reducing metals, preferably in particulate or finely divided form, include the following: aluminum, cesium, copper, lead, lithium, magnesium, mercury, potassium, sodium, titanium, uranium, zinc and zirconium. These are referred to as Chaplin metals. The group of these metals is referred to as the Chaplin metal group.

I claim:

1. A process for purifying aluminum chloride, comprising the steps of:

(a) providing crude aluminum chloride containing iron impurities;

(b) combining the crude aluminum chloride and additional iron to form a mixture; and (c) reactively subliming and desubliming the mixture to produce substantially pure aluminum chloride.

2. A process for purifying solid crude aluminum chloride containing iron impurities, comprising the steps of:

(a) mixing iron with the crude aluminum chloride; and (b) reactively subliming and desubliming the mixture.

3. The process according to claim 1 or 2, wherein the iron is added at a rate of 1 to 5 molar relative to the level of iron impurities in the crude aluminum chloride.

4. The process according to claim 1 or 2, wherein the iron is in the form of particles selected from the group consisting of iron filings, iron shavings and iron turnings.

5. The process according to claim 1 or 2, wherein the subliming is performed within a temperature range of between about 180° C. and about 350° C., and the desubliming is performed within a temperature range of between about 40° C. and about 180° C., both subliming and desubliming occur at a pressure of about one atmosphere.

6. The process according to claim 5, where the subliming and desubliming step is repeated until the aluminum chloride produced is about 99.8% or greater pure.

7. The process according to claim 5, wherein the subliming and desubliming step is repeated until the oxygen content of the aluminum chloride is less than about 0.05% by weight.

8. The process according to claim 5, wherein the subliming and desubliming step is repeated until the aluminum chloride is about 99.8% or greater pure and the oxygen content of the aluminum chloride is less than about 0.05% by weight.

9. A process for purifying solid crude aluminum chloride containing iron, the process comprising:

(a) reactively subliming and desubliming the iron-containing crude aluminum chloride in the presence of additional iron; and (b) passing the aluminum chloride vapor through a packed bed reactor containing iron particles at a temperature of between about 200° C. and about 500° C.

10. The process according to claim 9, wherein the subliming and desubliming step is performed within a temperature range and of between about 180° C. and 350° C. and at a pressure of about one atmosphere.

11. The process according to claim 10, wherein the subliming and desubliming step is repeated until the aluminum chloride is about 99.8% or greater pure.

12. The process according to claim 10, wherein the subliming step is repeated until the oxygen content of the aluminum chloride is less than about 0.05% by weight.

13. The process according to claim 10, wherein the subliming and desubliming step is repeated until the aluminum chloride is about 99.8% or greater pure and the oxygen content of the aluminum chloride is less than about 0.05% by weight.

14. In a process for producing and yielding metal chlorides comprising the steps of (i) providing aluminous ore, containing iron impurities, and a carbon source, (ii) drying the aluminous ore, (iii) drying the carbon source, (iv) mixing the dried aluminous ore, the dried carbon source, and a sulfur containing compound, (v) calcining the mixture in a first fluidized bed reactor in the presence of air to remove bound water, (vi) chlorinating the calcined product in a second fluidized bed reactor to produce crude metal chloride vapors and waste gases, (vii) condensing solid crude metal chloride vapors and separating the metal chloride vapors from the waste gases, and (viii) subliming and desubliming the solid crude metal chlorides to produce substantially pure aluminum chloride, an improved method of subliming and desubliming, the improvement comprising:

reactively subliming and desubliming the solid crude aluminum chloride in the presence of additional iron.

15. The improvement according to claim 13, wherein the subliming and desubliming comprises two or more subliming and desubliming steps.

16. The improvement according to claim 14 or 15, wherein the additional iron is in the form of iron particles selected from the group consisting of iron filings, iron shavings and iron turnings.

17. The improvement according to claim 15, wherein the subliming and desubliming steps are performed wherein a temperature range of between about 180° C. and about 350° C. and at a pressure of about one atmosphere.

18. The improvement according to claim 14, wherein the subliming and desubliming step is repeated until the aluminum chloride is about 99.8% or greater pure.

19. The improvement according to claim 14, wherein the subliming and desubliming step is repeated until the oxygen content of the aluminum chloride is less than about 0.05% by weight.

20. The improvement according to claim 14, wherein the subliming and desubliming step is repeated until the aluminum chloride is about 99.8% or greater pure and the oxygen content of the aluminum chloride is less than about 0.05% by weight.

21. The improvement according to claim 14, further comprising the step of:

condensing liquid titanium tetrachloride and liquid silicon tetrachloride from the waste gases by cooling the waste gases to between about minus 20° C. and about minus 30° C.

22. The improvement according to claim 21, further comprising:

separating a mixture of the liquid titanium tetrachloride and the liquid silicon tetrachloride from the waste gases.

23. The improvement according to claim 22, further comprising: distilling the liquid mixture to produce substantially pure titanium tetrachloride and substantially pure silicon tetrachloride.

24. The improvement according to claim 23, wherein the distilling step comprises a multiple stage distillation.

25. The improvement according to claim 21, further comprising recovering chlorine from a portion of the silicon tetrachloride.

26. The improvement according to claim 25, further comprising recycling the recovered chlorine to the second fluidized bed reactor.

27. A process for continuous production of metal chlorides, comprising the steps of:

(i) providing aluminous ore, containing iron impurities, and a carbon source;

(ii) drying the aluminous ore to less than about 5% moisture;

(iii) drying the carbon source to less than about 5% moisture;

(iv) mixing the dried aluminous ore, the dried carbon source, and a sulfur-containing compound;

(v) calcining the mixture in a first fluidized bed reactor in the presence of air at a temperature of between about 600° C. and about 950° C.;

(vi) chlorinating the calcined product in a second fluidized bed reactor at a temperature between about 500° C. and about 1000° C. in the presence of additional carbon source and additional sulfur-containing compound to produce crude metal chlorides and waste gases; and (vii) reactively subliming and desubliming the crude metal chlorides, in the presence of additional iron, within a temperature range between about 180° C. and 350° C. and at a pressure of about one atmosphere to produce purified aluminum chloride.

28. The process according to claim 27, wherein the subliming and desubliming step is repeated until the aluminum chloride is about 99.8% or greater pure and the oxygen content of the aluminum chloride is less than about 0.05% by weight.

29. The improvement according to claim 14, wherein the aluminous ore is dried to less than about 5% moisture, the carbon source is dried to less than about 5% moisture, the calcining in the first fluidized bed reactor is performed at a temperature of between about 600° C. and about 950° C., the chlorinating in the second fluidized bed reactor is performed at a temperature between about 500° C. and 1000° C., and the reactive subliming and desubliming of the crude metal chlorides is performed within a temperature range between about 180° C. and about 350° C.

30. The improvement according to claim 14, wherein the aluminous ore is dried to less than about 5% moisture, the carbon source is dried to less than about 1% moisture, the calcining in the first fluidized bed reactor is performed at a temperature of between about 600° C. and about 950° C., the chlorinating in the second fluidized bed reactor is performed at a temperature between about 600° C. and 1000° C., and the reactive subliming and desubliming of the crude metal chlorides is performed within a temperature range between about 180° C. and about 350° C.

31. A process according to claim 27, wherein chlorinating the calcined product is performed at a temperature between about 600° C. and about 1000° C.

32. A process according to claim 27, wherein chlorinating the calcined product is performed at a temperature between about 700° C. and about 1000° C.

33. A process according to claim 27, 31, or 32, wherein in the drying step the carbon source is dried to less than about 1% moisture.

* * * * *